United States Patent [19]

Zürcher et al.

[11] 4,356,688

[45] Nov. 2, 1982

[54] METHOD FOR JOINING TWO YARN PIECES, AND THE DEVICE FOR CARRYING OUT THE METHOD

[75] Inventors: Edwin Zürcher, Le Lignon; Guy Negaty-Hindi, Onex, both of Switzerland; Carlos Pujol, Barcelona, Spain

[73] Assignee: Battelle Memorial Institute, Carouge, Switzerland

[21] Appl. No.: 199,832

[22] Filed: Oct. 23, 1980

[30] Foreign Application Priority Data

Nov. 23, 1979 [CH] Switzerland ..... 10448/79

[51] Int. Cl.[3] ..... B65H 69/06; D01H 15/00

[52] U.S. Cl. ..... 57/22

[58] Field of Search ..... 57/22

[56] References Cited

U.S. PATENT DOCUMENTS 2,515,172 7/1950 Abbott ..... 57/22
3,315,458 4/1967 Alexander ..... 57/22
3,407,583 10/1968 Irwin et al. ..... 57/22
3,903,680 9/1975 Isern ..... 57/22
4,244,169 1/1981 Ligones et al. ..... 57/22

*Primary Examiner*—Donald Watkins
*Attorney, Agent, or Firm*—Karl F. Ross

[57] ABSTRACT

The yarn pieces to be joined are stretched between the two pairs of suction tubes (28, 29; 30, 31) and untwisted by being wound about spindles (20, 21). Hot compressed air fed along the surface of two blocks (32, 33) adjacent to the untwisted yarn portions remove free fibers and distribute the fiber tufts in the base of a channel formed in said blocks (32, 33). Said tufts are retained in the base of the channel by an electrostatic field formed with the aid of conductors (46) and the generator (GE). The blocks are then rotated about the rotation shafts (4, 5) until the channel edges are in contact with each other. Air is fed perpendicularly to the plane containing the fiber tufts in proximity to their respective ends in order to cause the fibers of the two tufts to interpenetrate, the spindles (20, 21) then being driven in the reverse direction in order to twist the fiber tufts and to disengage the yarn.

10 Claims, 4 Drawing Figures

METHOD FOR JOINING TWO YARN PIECES, AND THE DEVICE FOR CARRYING OUT THE METHOD

BACKGROUND OF THE INVENTION

Joining yarns is a common operation, in particular in winding machines. It is also carried out on knitting machines, looms and on certain free-ended spinning frames. For a very long time this operation has been carried out by knotting the two yarn ends to be joined, so that a fault then appears in the fabric.

Methods have already been proposed for replacing the knots by invisible joints which as near as possible approach spinning. The main difficulty of such methods is obtaining sufficient tensile strength in the yarn. In the case of a knot the strength corresponds substantially to that of the yarn, whereas in the case of an invisible joint in which the yarns are twisted together, this strength cannot in practice be equal to that of the yarn. However, a method of this type can only be acceptable if the strength of the joint is at least 80% of the initial strength of the yarn.

Among the proposed methods, mention can be made of U.S. Pat. No. 3,903,680, in which the yarn pieces are untwisted, the fibers of one end are then separated to form a cone after which the other end is inserted into the open end and its fibers are in their turn spaced apart so that they penetrate between the fibres of the initially opened end. These two ends are then twisted together to recreate the yarn twist and connect together the two pieces. This method enables results to be obtained which can be good depending on the thickness of the yarns and the yarn material. However, with certain yarns, in particular relatively thick yarns formed from synthetic fibers, certain difficulties arise particularly because of the density of the fibres which makes their interpenetration difficult, and also because of the remaining twist in the fibers.

Pneumatic methods have also been proposed for intermingling the fibers of the two pieces to be joined. Thus U.S. Pat. Nos. 3,306,020, 3,407,583 and 3,487,618 propose different methods in which the untwisted ends of the yarns to be joined are placed in a chamber, and a turbulent air stream is created in order to intermingle the fibers of the two ends such as to form a zone in which the two pieces are joined. The appearance of such a joint does not resemble the appearance of the yarn, and the strength of such a joint is generally barely more than half the initial yarn strength.

OBJECT OF THE INVENTION

The object of the present invention is to obviate the drawbacks of these methods, and to enable practically invisible high strength joints to be made, in particular for thick yarns made of synthetic fibers.

SUMMARY OF THE INVENTION

To this end, the present invention firstly provides a method for joining two yarn pieces, wherein the twist of one portion of each of the pieces is transferred by establishing an excess twist in the remainder of the pieces, and the loose fibers are removed from each of the pieces to form a tuft of fibers at the end of each piece. This method is characterized in that the fibers of each tuft are disposed substantially in a plane in an elongated shape, of which the maximum width is substantially greater than the diameter of the yarn and is situated in a zone close to the base of the tuft, then reducing until its end is reached, the end of the tuft is cut at a given length from its base, the two tufts are placed adjacent to each other so that the end of each of them is opposite the widest zone of the other tuft, part of the fibers of the end zone of each tuft is made to penetrate into the other tuft, and the transferred twist is re-established in the tufts.

The invention also relates to a device for carrying out the method and comprising two blocks movable between two positions, one in which they are spaced apart and the other in which they are adjacent, each block comprising a flat surface bordered laterally by two raised edges and having one end adjacent to a distribution slot connected to a source of compressed air, a cylindrical seat opening into the flat surface and receiving a cone, the point of which is adjacent to the surface, said seat being connected to the source by a conduit opening laterally and directed against the axis of the cone.

BRIEF DESCRIPTION OF THE DRAWING

The accompanying drawing is a diagrammatic illustration, by way of example, of an embodiment of the device for carrying out the method of the invention.

In the Drawing.

SPECIFIC DESCRIPTION

Figure 1:
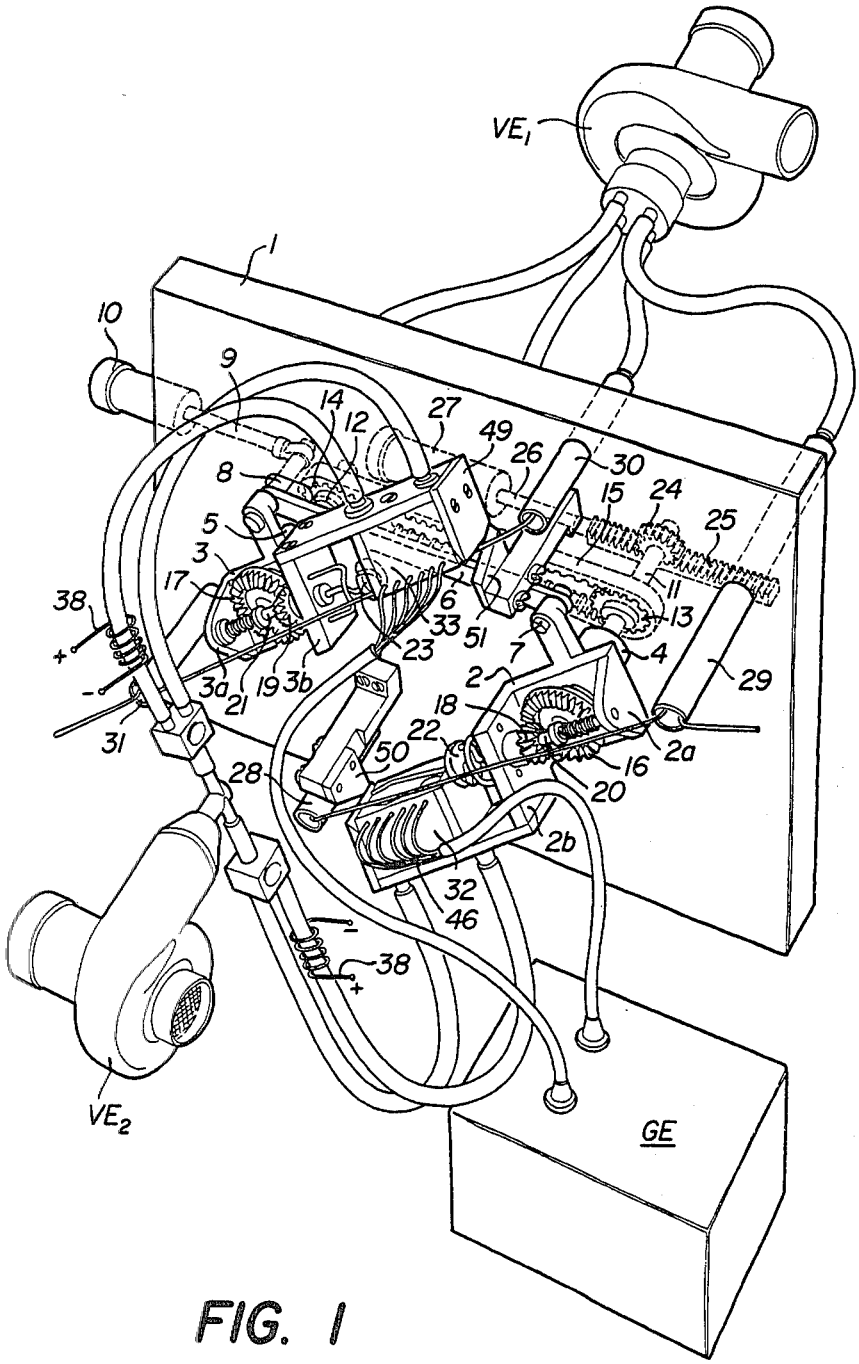
FIG. 1 is a perspective view of the essential elements of said device.

The device illustrated in FIG. 1 comprises a frame 1 having two supports 2, 3 pivoted in the frame 1 by way of two hollow shafts 4 and 5. The two supports 2 and 3 are connected to each other by a connecting rod 6, the ends of which are hinged to the supports by shafts 7 and 8 parallel to the hollow shafts 4 and 5. The shaft 8 is also connected to the rod 9 of a cylinder 10 designed to rotate the supports, which are kinematically connected by the connecting rod 6, about the axes of the hollow shafts 4 and 5 in such a manner as to move the supports from the position shown in FIG. 1 to a position in which the supports 2 and 3 are aligned.

The two hollow shafts 4 and 5 are traversed by two other shafts 11 and 12 which extend to behind the frame 1. Each shaft 11 and 12 is rigid with a pinion 13, 14 respectively. The pinions are connected together by a toothed belt 15. The front end of each shaft 11, 12 traverses one of the supports 2, 3 respectively, and is rigid with a bevel pinion 16, 17 respectively, engaged with two bevel pinions 18, 19 respectively. Each bevel pinion 18, 19 is rigid with a spindle 20, 21 respectively, mounted between two parallel cheeks *2a*, *2b* and *3a*, *3b* respectively, on the supports 2 and 3. Each spindle 20, 21 terminates in a radially slit disc 22, 23 respectively. The rear end of the shaft 11 is rigid with a second pinion 24 engaged with a rack 25 rigid with the rod 26 of a cylinder 27. This drive mechanism 24 to 28 serves for rotating the spindles 20 and 21 in mutually opposite directions, the spindle 21 being driven by the belt 15 which connects the pinions 13 and 14.

Two suction tubes 28, 29 and 30, 31 respectively are fixed in the frame 1 on one side and the other of each support 2, 3 respectively. Said tubes are connected to the inlet of a fan $VE_1$ and are disposed in pairs such that a yarn held between each pair of suction tubes rests against the edge of the discs 22, 23 respectively, and passes adjacent to a block 32, 33 respectively. Each block 32, 33 is rigid with the support 2, 3 respectively.

Said blocks are shown in detail in FIGS. 2 and 3, to which reference will be made for the continuation of this description. As they are identical, only one of them will be described. The block is of an insulating material, for example a plastic material. Its upper face comprises a central channel 34, the base of which serves as a support surface for spreading out the fibers forming the end tuft of the yarn piece to be joined. The depth of this channel is of the order of 0.3 mm. The surface of the block 32 bordering the channel 34 is covered with a layer 35 of a plastic material more flexible than that of the block, to act as a seal gasket when the two blocks are in the position illustrated in FIG. 2. The thickness of the layer 35 is of the order of 0.1 mm. The block 32 also comprises a feed conduit 36 connected to a compressed air source $VE_2$ (FIG. 1) which can be heated by means of an electric heating element 38. The feed conduit 36 communicates with a distribution chamber 39 which opens into the support surface defining the base of the channel 34, to form a nozzle 40 by way of a slot having a length substantially equal to the width of the channel 34, and of which one of the lips 41 parallel to the base of the channel 34 keeps the jet from the nozzle 40 along the support surface of the channel 34. FIG. 3 shows that the width of the channel is not constant. Following it from the outlet of the nozzle 40, it can be seen that it widens over about $\frac{1}{4}$ to 1/5 of its length by about 40% of its initial width, and it then progressively returns to this initial width over the remainder of its length.

The support surface of the base of the channel 34, at that part thereof corresponding to the portion in which said channel enlarges at the outlet of the nozzle 40, comprises an aperture in a position corresponding to a cylindrical seat 42 which traverses the block 32 perpendicular to the base of the channel 43. The cylindrical seat 42 receives a rod 43 which fits in by friction and has its upper end terminating in a cone 44, the point of which reaches just to the level of the base of the channel 44. A conduit 45 centred on the axis of the cone 44 and situated at about $\frac{1}{3}$ of the height of the cone from its base connects the cylindrical seat 42 to the distribution chamber 39.

The block 32 also comprises a set of electrical conductors 46 disposed transversely to the channel 34 and spaced apart longitudinally. The electrical conductors are situated in proximity to the support surface of the base of the channel 34, and are embedded in the plastic material of the block 32 such that a dielectric separates the electrical conductors 46 from the support surface. The conductors are connected to an electrostatic generator GE.

Three very fine conduits 52 of 0.25 mm diameter open into the support surface of the base of the channel 34 between the four conductors 46 starting from the open end of the channel 34, and are connected to the source of compressed air $VE_2$.

Each block 32, 33 carries a cutting blade 48, 49 respectively on its lateral face adjacent to the end of the channel 34, and a second cutting blade 50, 51 respectively is fixed to the frame 1 in the respective trajectories of the blades 48, 49 which are described during the movement of the supports 2 and 3 from the position shown in FIG. 1 to the position in which the plates 32 and 33 are brought into contact with each other.

Figure 3:
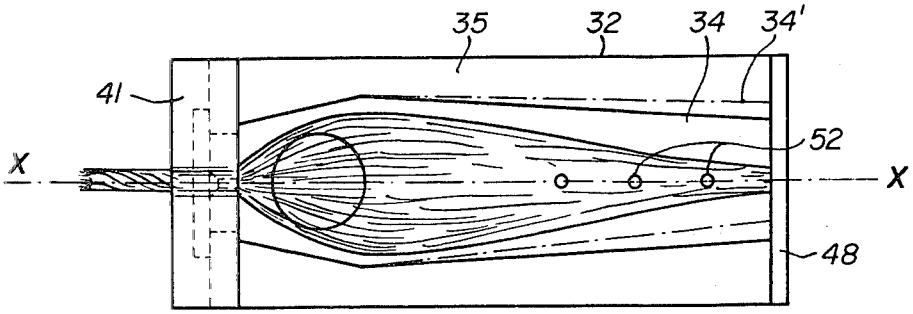
FIG. 3 is a view taken along the line III—III of FIG. 2.
Figure 4:
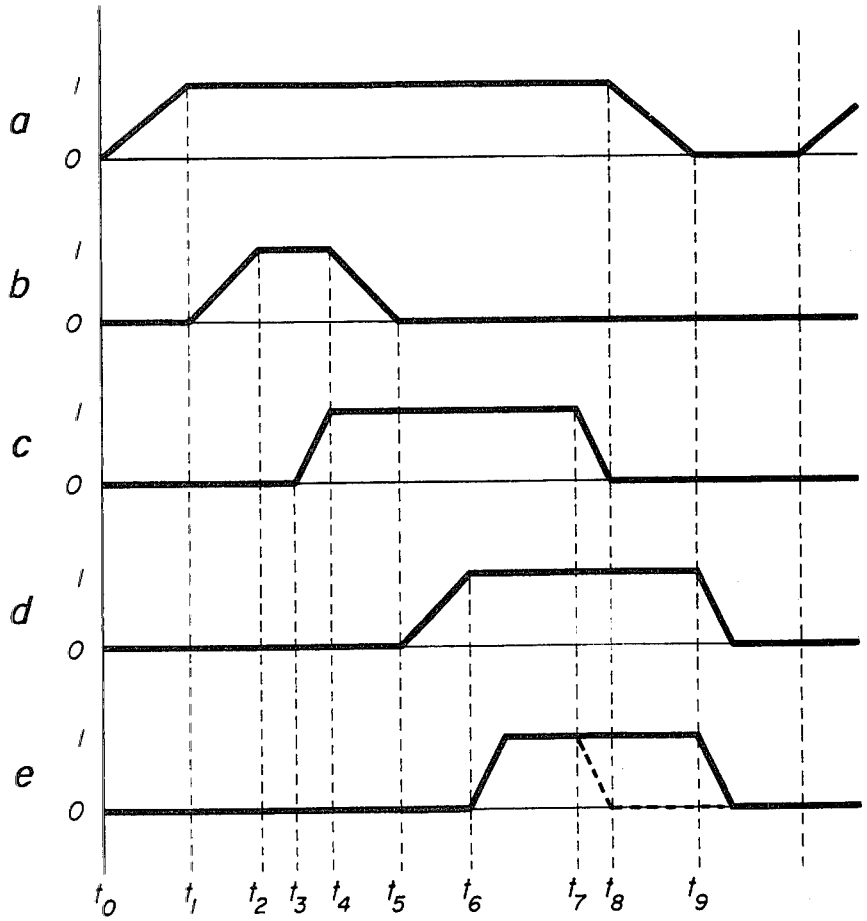
FIG. 4 is an operational diagram.

The joining method carried out with the aid of the device is described hereinafter with reference to FIGS. 1 to 3 and to the operational diagram of FIG. 4.

The two yarn pieces to be joined are each brought opposite the two suction tubes 28, 29 and 30, 31 respectively, all four of which are connected to the inlet of the fan $VE_1$, such that the yarn portions held between the suction tubes 28, 29 and 30, 31 respectively are held in contact with the discs 22, 23 respectively. This moment is assumed to correspond to the time $t_0$ on the diagram of FIG. 4. On this diagram, the functions are indicated by 0 and 1, 0 corresponding to a rest or starting position of the member carrying out the function, and 1 a position in which the member is displaced from its rest or initial position. From time $t_0$ to time $t_1$, function a corresponds to the rotation of the discs 22, 23 rigid with the spindles 20, 21. During this rotation, the respective radial slits in the discs 22, 23 reach a position facing the yarns held between the tubes 28, 29 and 30, 31 respectively and resting on the periphery of the discs 22, 23, such that the yarns penetrate into said radial slits and wind about the spindles 20, 21 to cause untwisting of the yarns between the tubes 28 and 30 and the discs 22, 23 respectively.

Blowing of air through the nozzle 40 (function b) commences at time $t_1$, the untwisted yarn lying against the support surface of the base of the channel 34 being then subjected to this jet which removes the fibres not firmly connected to the piece of yarn wound about each spindle 20, 21. The blown air is heated by the heating member 38. Its temperature is of the order of 60° to 90° C. and is intended to overcome the remaining twist in the fibers in order to spread out the tuft of fibers over the support surface of the base of the channel 34, and to enable said fibers to remain substantially adjacent to the plane of the surface. In this respect, the fibers forming a tuft at the end of an untwisted yarn partly preserve, after untwisting, that deformation which they had following their twist, and thus cannot be spread out on a surface. The hot air eliminates all or part of the deformation of the fibers. Furthermore, the air stream adjacent to the base of the channel 34, as formed by the nozzle 40, extends the tuft of untwisted and heat-treated fibers along the base of said channel 34. The secondary air jet formed through the conduit 45 provided between the distribution chamber 39 and seat 42 is directed against the cone 44, and is deviated into the main air stream from the nozzle 40. The effect of this is to create an enlargement of the main jet, and a corresponding enlargement of the tuft of fibers. The lateral walls of the channel 34 then narrow in the direction of the open end of the channel, to cause a contraction of the stream and of the fibers. Thus, the tuft of fibers spread out over the base of the channel 34 is substantially in the shape of a flame FIG. 3, and it will be seen hereinafter that this shape is of great importance for the quality of the joint.

To improve the holding of the fibers against the support surface of the base of the channel 34, the conductors 46 are energized (function c) at time $t_3$ by the electrostatic generator GE to create a field between the conductors 46 and the rest of the apparatus which is at ground potential. The thickness of the dielectric separating the conductors from the base of the channel 34 must be small, otherwise the fibers cannot be charged electrostatically. In this example, the thickness of the dielectric is of the order of 0.3 mm. As a modification, the same result could be obtained pneumatically by sucking air through the conduits 52.

Figure 2:
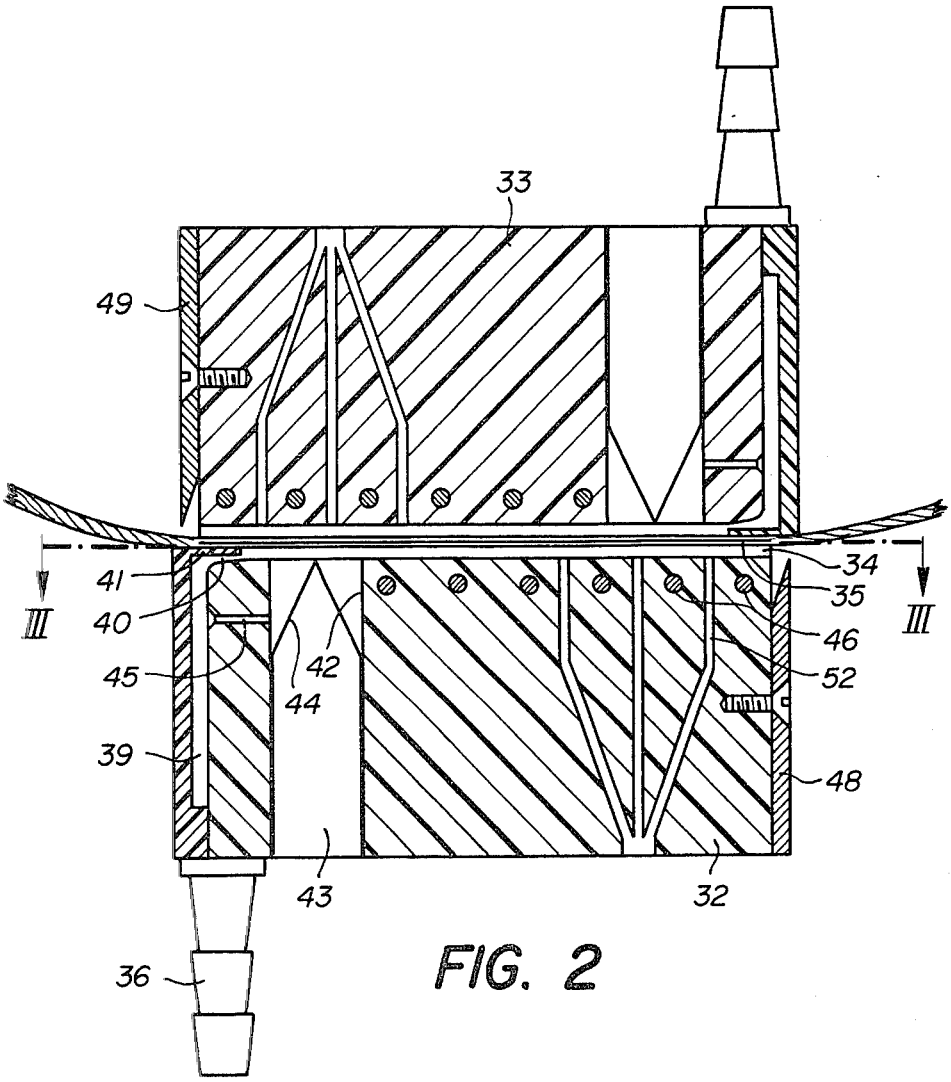
FIG. 2 is an enlarged section through a detail of FIG. 1.

From time $t_4$ to time $t_5$, the air flow through the nozzle 40 and conduit 45 (function b) is stopped, and from time $t_5$ to $t_6$ the blocks 32 and 33 are brought against each other (function d) into the position shown in FIG. 2 by rotating the supports 2 and 3 under the action of the cylinder 10. During this movement, the fibers of the two tufts formed on the blocks 32 and 33 are cut by mobile blades 48, 49 respectively, which encounter the fixed blades 50, 51 respectively during their passage.

When the two blocks 32 and 33 are brought jointly against each other, the two channels 34 form a single passage open at its two ends. The resultant extra thickness of the layers 35 forms an opening of about 0.5 mm between the base of each channel 34 and the respective deflectors 41, to enable the yarn to pass.

Function e, corresponding to feeding compressed air through the conduits 52, commences at time $t_6$ when the blocks 32 and 33 are adjacent (function d). The purpose of the small air jets formed at the exit of the conduits 52 is to cause the fibers at the end of each tuft to penetrate into the sheet of fibers of the other tuft so as to obtain interlacing. This operation demonstrates the importance of the flame shape given to each tuft. Without this shape, part of the end fibers interlaced by the conduits 52 would pass to the side of the sheet of fibers of the adjacent tuft so that these fibers would not participate effectively in the joint, and they would project from the yarn to make the joint visible. If the sheet in which the end fibers of the tuft are interlaced is wider than the end, the probability of these fibres penetrating into said sheet increases considerably.

Given that further tension in the two superposed fiber tufts will cause the fibers disposed in a plane to deform progressively into a helix, and that in particular the base of each tuft will tend to assume a S cross-section, it is desirable for the respective ends of the tuft fibers to be slightly offset sideways where the adjacent tuft tends to become concave, and to thus envelop this end in order to ensure that it is completely imprisoned in the adjacent tuft. In this respect, if, at the moment when twisting begins, the end of the tuft is in a convex part of the S formed in cross-section by the base of the tuft at the beginning of twisting, the end of the yarn will not be imprisoned, and it might escape after joining. This result can be obtained in practice by forming the channels 34 with a certain asymmetry about the longitudinal axis x—x of each block 32, 33 as shown by the dot-dash line 34' of FIG. 3. The edges of the channel 34 of the block 33 will, of course, form an angle of 180° with those of the block 32 when the blocks are in the position shown in FIG. 2.

Penetration of the fibres at the end of each tuft into the fibers of the adjacent tuft before twisting the tufts in order to reform the yarn at the point of joining is of primary importance. This is because without this interpenetration of the fibers of the adjacent tufts, the effect of twisting the tufts will be to close the tufts up again about themselves so that instead of recreating the yarn structure obtained during spinning, two compact masses of fiber twisted together will be obtained. The strength of such a connection will be very low, and will not resist repeated tension or passage over a yarn guide.

At time $t_7$, the function c corresponding to the electrostatic field is stopped, and at time $t_8$ the discs 22 and 23 are returned to their initial position (function a), i.e. they are rotated in the reverse direction by the return stroke of the rod 26 of the cylinder 27. The excess twist induced into each yarn piece would about the spindles 20, 21 respectively during the initial untwisting is transferred into the tufts, the fibers of which interpenetrate so that a structure is created at the point of joining which is very close to spinning. Simultaneously, as each yarn piece is unwound from its spindle 20, 21 respectively, it is disengaged from the radial slit in the discs 22, 23 respectively.

At time $t_9$ the functions d and e terminate, i.e. the cylinder 10 returns the supports 2 and 3 to the position shown in FIG. 1, and the yarn stretched between the suction tubes 29 and 31 can then be disengaged from the apparatus.

It is important to note that the actual means which carry out the described joining method comprise no mechanical element, as the mechanical means are used only as control elements, i.e. indirectly. The quality of the joints obtained and their appearance are excellent, the joint strength being on an average about 90% of the initial strength. The method has been tested in particular on yarns formed from artificial fibers cut to the length of cotton fibers, i.e. of the order of 40 mm, and representative of fibers which currently form synthetic or artificial yarns. The thickness of the yarns was of the order of 120 tex. In certain cases, it could be desirable to heat the joined yarn pieces to between 60° C. and 90° C. before removing them from the apparatus in order to prevent a certain degree of untwisting after having twisted the two tufts.

What we claim is:

1. A method of splicing two yarn pieces, wherein the twist of one portion of each of said pieces is transferred by establishing an excess twist in the remainder of said pieces, and the loose fibers are removed from each of said pieces to form a substantially flat tuft of fibers at the end of each piece, said method comprising the steps of:

disposing the fibers of each tuft substantially in a plane in an elongated shape of which the maximum width is substantially greater than the diameter of the yarn and is situated in a zone close to the base of the tuft, the width then decreasing until its end is reached;

cutting the ends of the tufts at given lengths from their bases;

disposing the two tufts adjacent to each other so that the end of each of them is opposite the widest zone of the other tuft;

causing part of the fibers of the end zone of each tuft to penetrate into the other tuft; and re-establishing transferred twist in said tufts.

2. A method as defined in claim 1, wherein an electrostatic field is formed in order to retain the fibers in said plane.

3. A method of splicing two yarn pieces, wherein the twist of one portion of each of said pieces is transferred by establishing an excess twist in the remainder of said pieces, and the loose fibers are removed from each of said pieces to form a substantially flat tuft of fibers at the end of each piece, said method comprising the steps of:

disposing the fibers of each tuft substantially in a plane in an elongated shape of which the maximum width is substantially greater than the diameter of the yarn and is situated in a zone close to the base of the tuft, the width then decreasing until its end is reached;

cutting the ends of the tufts at given lengths from their bases;

disposing the two tufts adjacent to each other so that the end of each of them is opposite the widest zone of the other tuft;

causing part of the fibers of the end zone of each tuft to penetrate into the other tuft; and re-establishing transferred twist in said tufts, the tuft fibers being disposed in a plane by placing said fibers in a gas stream adjacent to a flat support surface and guided by a channel, the edges of which laterally bound said support surface.

4. A method as defined in claim 3 wherein an aperture is provided in said support surface opposite the zone in which the tuft of fibers is required to present its maximum width, and a gas discharge is formed at the center of said aperture in order to locally increase the width of said stream.

5. A method of splicing two yarn pieces, wherein the twist of one portion of each of said pieces is transferred by establishing an excess twist in the remainder of said pieces, and the loose fibers are removed from each of said pieces to form a substantially flat tuft of fibers at the end of each piece, said method comprising the steps of:

disposing the fibers of each tuft substantially in a plane in an elongated shape of which the maximum width is substantially greater than the diameter of the yarn and is situated in a zone close to the base of the tuft, the width then decreasing until its end is reached;

cutting the ends of the tufts at given lengths from their bases;

disposing the two tufts adjacent to each other so that the end of each of them is opposite the widest zone of the other tuft;

causing part of the fibers of the end zone of each tuft to penetrate into the other tuft; and re-establishing transferred twist in said tufts the fibers of each tuft being heated to a temperature of the order of 60° to 90° C. while said fibers are being disposed in a plane.

6. A method as defined in claim 3 or claim 5 wherein said gas stream is heated to a temperature of the order of 60° to 90° C.

7. A method of splicing two yarn pieces, wherein the twist of one portion of each of said pieces is transferred by establishing an excess twist in the remainder of said pieces to form a substantially flat tuft of fibers at the end of each piece, said method comprising the steps of:

disposing the fibers of each tuft substantially in a plane in an elongated shape of which the maximum width is substantially greater than the diameter of the yarn and is situated in a zone close to the base of the tuft, the width then decreasing until its end is reached;

cutting the ends of the tufts at given lengths from their bases;

disposing the two tufts adjacent to each other so that the end of each of them is opposite the widest zone of the other tuft, causing part of the fibers of the end zone of each tuft to penetrate into the other tuft, and re-establishing transferred twist in said tufts, air jets being directed perpendicular to the planes in which the fibers of the respective tufts are disposed and in proximity to the respective end zones of said tufts, and being directed such as to cause part of the fibers of each of said ends to penetrate into the fibers of the other end.

8. A device for joining two yarn pieces wherein the twist of one portion of each of the pieces is transferred by establishing an axial twist in the remainder of said pieces and loose fibers are removed from each of said pieces to form a tuft of fibers, the improvement which comprises in combination means for transferring the twist of said portion of each of said fibers, two blocks movable between two positions, one in which they are spaced apart and the other in which they are adjacent, means for moving said blocks between said positions, each block comprising a flat surface bordered laterally by two raised edges and having one end adjacent to a distribution slot connected to a source of compressed air, a cylindrical seat opening into said flat surface and receiving a cone, the point of which is adjacent to said surface, said seat being connected to said source by a conduit opening laterally and directed against the axis of said cone, said distribution slots being at opposing ends of said blocks when these latter are adjacent to each other.

9. A device as claimed in claim 8 wherein said block is of a dielectric material, and comprises at least one electrical conductor underlying said flat surface and connected to an electrostatic generator.

10. A device as claimed in claim 8 wherein the raised edges which laterally border said flat surface of one of said blocks form a channel asymmetrical about its longitudinal axis, the corresponding raised edges of the other of said blocks forming a channel which is asymmetrical about its horizontal axis and which, when said blocks are in an adjacent position, is mirror symmetrical to the other of said channels about a transverse axis cutting the central part of said channels, so that the end of each tuft becomes disposed opposite a base part of the adjacent tuft, which becomes convex after axial twist is applied to said tufts.

* * * * *

UNITED STATES PATENT AND TRADEMARK OFFICE

CERTIFICATE OF CORRECTION

PATENT NO. : 4,356,688

DATED : 2 November 1982

INVENTOR(S) : Erwin Zürcher et al

It is certified that error appears in the above-identified patent and that said Letters Patent is hereby corrected as shown below:

ON THE TITLE PAGE, item [75], the first inventor's name should read: -- Erwin Zürcher --.

Signed and Sealed this

First Day of March 1983

[SEAL]

*Attest:*

GERALD J. MOSSINGHOFF

*Attesting Officer*

*Commissioner of Patents and Trademarks*